US006167828B1

(12) United States Patent
Chase

(10) Patent No.: US 6,167,828 B1
(45) Date of Patent: Jan. 2, 2001

(54) BOAT MOORING ASSEMBLY

(76) Inventor: Marshall S. Chase, 473 Kent Hollow Rd., Kent, CT (US) 06757

( * ) Notice: Under 35 U.S.C. 154(b), the term of this patent shall be extended for 0 days.

(21) Appl. No.: 09/455,736

(22) Filed: Dec. 4, 1999

(51) Int. Cl.[7] ..... B63B 21/00
(52) U.S. Cl. ..... 114/230.15
(58) Field of Search ..... 114/230.1, 230.15, 114/230.17, 230.19, 343, 362, 242

(56) References Cited

U.S. PATENT DOCUMENTS

| | | | | |
|---|---|---|---|---|
| 4,899,681 * | 2/1990 | Ottsman et al. | ..... | 114/230 |
| 5,188,054 * | 2/1993 | Jacobs, Jr. | ..... | 114/250 |
| 5,408,946 * | 4/1995 | Jones et al. | ..... | 114/230 |
| 5,499,591 * | 3/1996 | Chippas | ..... | 114/230 |
| 6,067,926 * | 5/2000 | Robinson | ..... | 114/362 |

* cited by examiner

*Primary Examiner*—S. Joseph Morano
*Assistant Examiner*—Patrick Craig Muldoon

(57) ABSTRACT

A mooring assembly for securing a boat to a waterfront structure such as the surface of a dock has a pair of elongate mooring arms each having a pivot end pivotally coupled to the waterfront structure in horizontally spaced-apart relationship, and each having a mooring end remote from the pivot end, that is displaceable toward and away from the surface of the water as the arm is pivoted about the pivot end. At the mooring end of each mooring arm, a mooring pin extends from the arm in a direction that is generally perpendicular to the longitudinal axis of the arm, so that as the mooring end is displaced toward the water when the arm is pivoted about the coupling to the waterfront structure, the mooring pin can be inserted into a suitably dimensioned aperture in a mooring bracket mounted on the surface of a boat. At the pivot end of each arm, a pivot pin projects at right angles to the longitudinal axis of the arm and engages a pivot bracket that is configured for mounting to the waterfront structure in any well known manner. In addition to the pivot pin, an elongate spacer rod extends from the pivot end of each mooring arm in coaxial alignment with the associated mooring pin, and the respective spacer rods of the two mooring arms are mounted in opposed, coaxial alignment when the pivot brackets are mounted on a waterfront structure, so that the two mooring arms may be coupled to each other through the space rods. A tubular spacing sleeve has an open interior space and two open, opposite ends which telescopically receive the respective ends of the two spacer rods. The spacer sleeve includes provisions for maintaining the opposed ends of the spacer rods in suitably spaced apart relationship; one embodiment incorporates spacer pins that are inserted into spaced-apart through holes extending diametrically through opposed portions of the wall sleeve, and in another embodiment a pair of set screws extend through spaced-apart threaded openings in the wall of the sleeve for threaded advancement and retraction into and out of the central interior space. A pair of spacer elements each having a plurality of annular grooves are telescopically displaceable within the interior space of the sleeve where they may be locked into desired position by engagement of the set screws in a desired annular groove.

9 Claims, 5 Drawing Sheets

BOAT MOORING ASSEMBLY

BACKGROUND OF THE INVENTION

This invention relates generally to the mooring of a boat to a waterfront structure such as a dock, and it relates more specifically to a mooring assembly that is capable of securing a boat to the waterfront structure in a relatively fixed orientation with a fixed distance between the structure and the boat, while readily accommodating variations in the relative elevation of the waterfront structure and the boat, such as may be caused by tides, waves and other fluctuations in water level.

It is known to moor boats to docks and the like by providing a rigid arm that is movably mounted at one end to a dock and is coupled at its other end to a boat, so as to keep the boat at a fixed distance from the dock. It is also known to use a pair of such rigid arms suitably spaced from one another and braced to remain substantially perpendicular to the edge of a dock, so as to maintain a fixed orientation between the boat and the dock. However, prior art devices of this type have been characterized, generally, by expensive and cumbersome structures that are difficult to deploy and that occupy a substantial length of valuable space along the edge of the dock.

BRIEF SUMMARY OF THE INVENTION

Accordingly, it is an object of this invention to provide a boat mooring assembly that is inexpensive to produce, that is simple in structure, and that occupies a minimum length of dock space. Mounting of the assembly to a dock or other waterfront structure requires only a pair of spaced-apart pivot brackets that can be mounted on the edge of the waterfront structure with each pivot bracket having a pivot aperture therein and the pivot apertures being alignable in substantially co-axial, spaced-apart relationship such that the common axis of the apertures is parallel to the surface of the water that lies adjacent to the waterfront structure. In turn, the boat requires only a pair of spaced-apart mooring brackets mounted on a surface of the boat with each mooring bracket having a mooring aperture; the axes of the mooring apertures are aligned in parallel relationship with each other and each aperture lies in a plane that is substantially parallel to the surface of the water.

These and other and further objects, features and advantages of the present invention will be made obvious to those having ordinary skill in this art by the following specification, claims and drawings, in which:

DETAILED DESCRIPTION OF THE INVENTION

Figure 1:
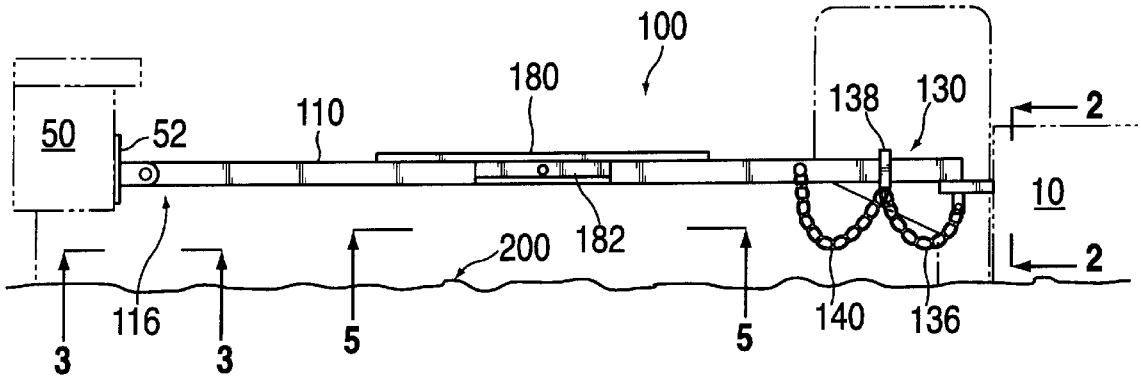
FIG. 1 is a water-level elevation view of a boat moored to a waterfront structure by a mooring assembly in accordance with this invention.
Figure 2:
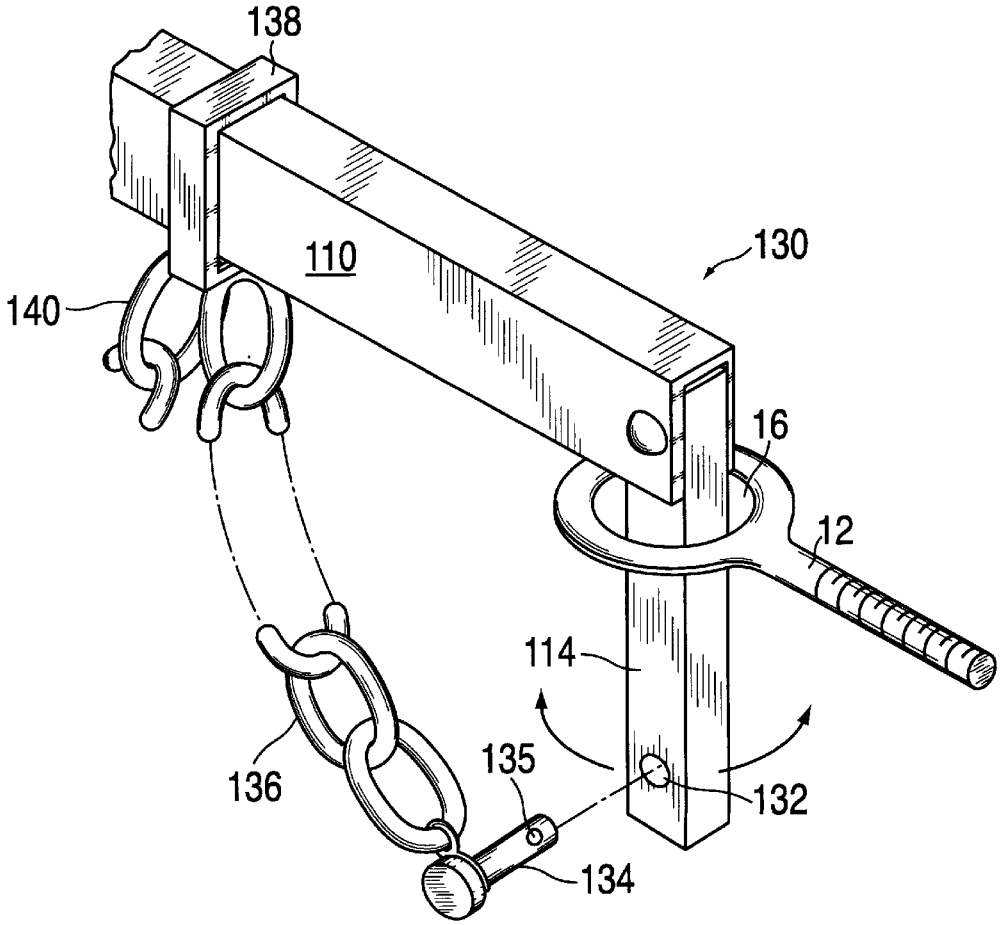
FIG. 2 is a pictorial representation taken in the general direction 2—2 of FIG. 1, showing details of the mooring end of a mooring arm that forms part of the assembly of FIG. 1.
Figure 3:
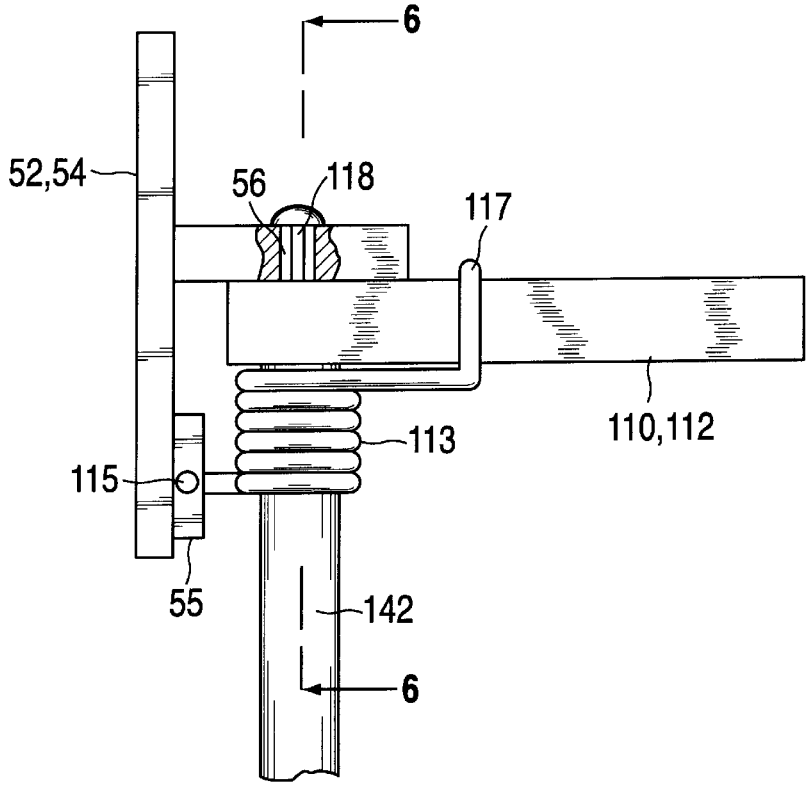
FIG. 3 is a pictorial representation taken in the direction 3—3 of FIG. 1, showing details of the pivot end of a mooring arm that forms part of the mooring assembly of FIG. 1.
Figure 4:
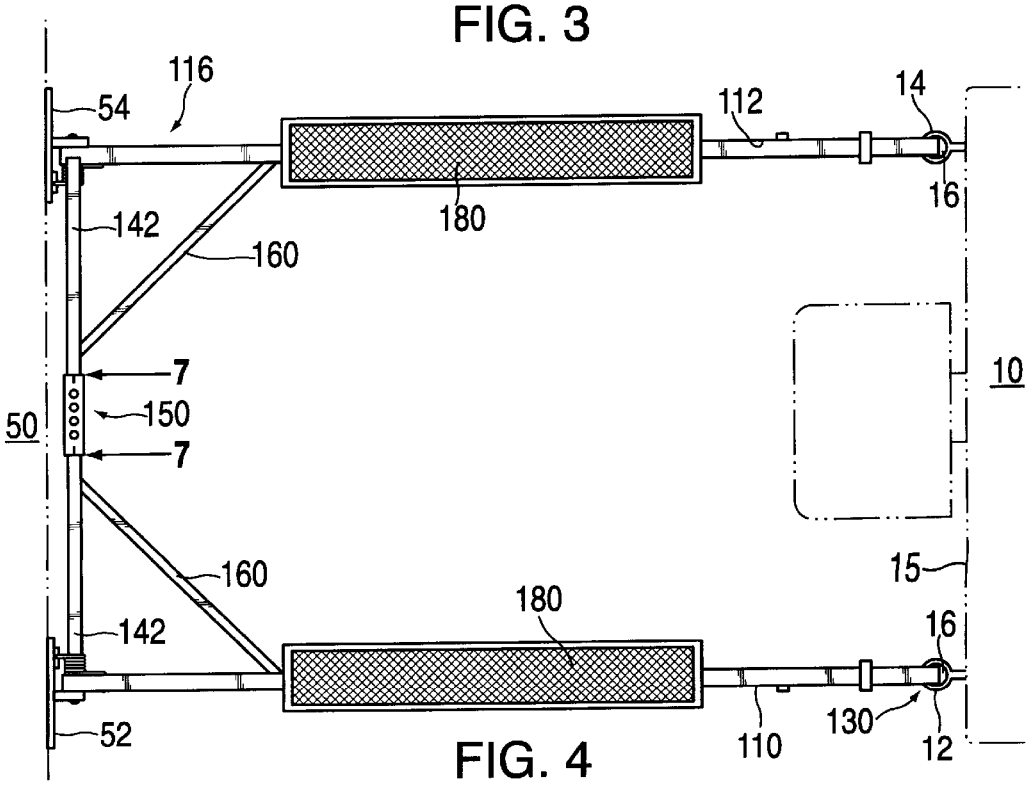
FIG. 4 is a plan view of the mooring assembly of FIG. 1.

Referring now more specifically to the drawings, FIGS. 1 and 4 may be seen to represent a boat 10 moored to a waterfront structure 50 by means of a mooring assembly 100 in accordance with this invention. The mooring assembly 100 comprises a pair of elongate mooring arms 110, 112 extending between the boat 10 and the waterfront structure 50. A each mooring arm is pivotally coupled to a respective one of a pair of pivot brackets 52, 54. The pivot brackets in turn are mounted in any well-known manner to the structure 50 in generally fixed, spaced-apart relationship. The spacing between brackets 52 and 54 is selected in accordance with the size and shape of boat 10 in a manner that will be understood readily by those having skill in this art in the context of this disclosure. Each pivot bracket 52, 54 includes a pivot aperture 56 as shown in FIG. 3, and the brackets 52, 54 are positioned so that the apertures 56 are axially aligned with their common axis extending at a uniform height above the surface of the water adjacent to the structure 50. The pivot brackets 52, 54 may assume the form illustrated, but, for economy and ready availability, various other obvious and/or well-known forms or shapes of apertured brackets, such as for example, a common screw-eye, may be used.

As shown in FIG. 1 and 4, a pair of spaced-apart mooring brackets 12, 14 are mounted on transom 15 or on any other suitable exposed outer surface of a boat 10. It should be understood readily that the boat 10 is merely illustrative herein, and the particular configuration and/or structure of the boat does not form any part of this invention. Each mooring bracket 12,14 includes a mooring aperture 16, and in use, apertures 16 are aligned on the boat in substantially co-planar relationship parallel to the surface of the water in which the boat floats, for reasons which will be made evident herein.

Each mooring arm 110, 112 has a pivot end 116 associated with its respective pivot bracket 52, 54. The arms are pivotally coupled to the brackets by means of a pivot pin 118 that is positioned within a pivot aperture 56 in the bracket. The pivot pin 56 can be seen to extend at a right angle to the longitudinal, or elongate axis of the arms 110,112. As a result of this form of coupling, each arm is capable of pivotal displacement in a plane that is substantially perpendicular to the surface of the water 200. Displacement of the arms in this manner allows the mooring end 130 of each arm, which is remote from the pivot end 116, to be displaced toward and away from the surface of the water 200, for the purposes disclosed herein.

More specifically, a mooring pin 114 extends from the mooring end 130 of each arm 110, 112 substantially at right angles to the elongate axis of the arm. When the arms are pivoted in the manner already described, mooring pins 114 can be readily inserted into the mooring apertures 16 in a respective one of the mooring brackets 12,14. For this purpose, it can be seen that mooring pin 16 and the pivot pin 118 in each arm 110,112, lie in planes that intersect the longitudinal axis of the arm and are substantially perpendicular to each other; thus, as the arms 110,112 pivot about a substantially horizontal axis, mooring pins 118 move in a substantially vertical plane so that they can enter vertically into the horizontally disposed mooring apertures 16. It can be seen readily in FIG. 1, that the weight of mooring arms 110,112 acting about pivot pins 118 will tend to urge the mooring ends 130 of the arms downwardly against mooring brackets 12,14 which will in turn support the mooring ends 130 of the arms, thereby maintaining mooring pins 114 in position within the mooring brackets. be understood readily that other cross-sectional configurations such as a cylindrical pin may be used, if preferred. A cylindrical pin may be preferred to reduce wear between the outer surface of the pin and the inner surface of mooring brackets 12,14.

Because the weight of the mooring arms may be substantial, the vertical load that the mooring ends 130 impose on mooring brackets 12,14 may be reduced to a desired extent by the use of biasing springs such as coil springs 113. As shown in FIG. 3, the helical coil spring 113 is interposed between arm 110,112 and pivot bracket 52,54 around spacer rod 142, with one end 117 of the spring captured to arm 110,112 and the other end 115 of the spring captured to the base of the mooring block 52,54. The spring is installed in its "captured" position so as to apply the desired amount of torque to the arm 110, 112 about the axis of pivot pin 118 in a direction opposite to the torque induced in the mooring arm by the force of gravity. Accordingly, the force required to lift the free mooring end 130 of either arm against the force of gravity may be reduced to any desired extent consistent with the predetermined characteristics of spring 113.

To further facilitate retention of the mooring pins within the mooring brackets, each mooring pin 114 is provided with a transversely positioned retention aperture 132 that is dimensioned to receive a retention pin 134. The retention pin 134 serves to prevent withdrawal of the pin 114 through the mooring aperture 16 in the mooring bracket 12,14. Further protection against unintentional withdrawal of mooring pin 114 from mooring bracket 12, 14, may be provided by forming a transverse locking aperture 135 near the free end of pin 134, to receive a fastening device such as a cotter pin (not shown) or even a padlock (not shown). The locking aperture thus helps to preclude withdrawal of the retention pin from the mooring pin. To help avoid inadvertent loss of retention pins 134, a retention chain 136 is provided; the retention chain 136 is coupled to a retention collar 138 which surrounds the respective arm 110,112. If desired, a second, or collar retention chain 140 may be coupled at one end to the collar 138 and at its other end secured to the arm 110,112 so as to help maintain the collar 138 in a desired location on the arm where it will be readily available for convenient use.

As shown most dearly in FIG. 4, each mooring arm 110,112 further includes a spacer rod 142 that extends perpendicularly to the arm from the mooring end 130, in axial alignment with pivot pin 118. The spacer rods 142 are positioned to extend toward each other in axial alignment with each other, along the waterfront structure 50, and their opposed free ends are coupled through a spacer sleeve 150 to maintain their axial alignment. Tubular spacer sleeve 150 has a cylindrical central interior space 151 with open opposite ends 153, through which the free ends of the spacer rods 142 are telescopically received. Sleeve 150 is maintained in substantially centered position overlapping the end of each spacer rod by means of spacer pins 152 that are selectively inserted through selected pairs of a plurality of transverse, substantially diametrical through-holes 154 that are formed in the wall structure of sleeve 150. Pins 152 can be retained in position within holes 154 in any well-known manner, as for example, by means of locking rings 155 inserted through transverse access holes 156 in the body of pins 152. It should now be apparent that maintaining the spacer rods in axial alignment in this manner provides significant stability for the mooring arms 110,112 that reduces weakening of the arms and the pivot brackets 52,54 that might otherwise be caused by excessive torquing and twisting.

Stability of arms 110, 112 is further enhanced by the provision of bracing members 160 that extend diagonally from a point on mooring arms 110,112 intermediate the ends thereof, to a point on the associated spacer rod intermediate the opposite ends thereof. The opposite ends of the bracer rod 160 may be fastened to the spacer rods and to the mooring arms in any well-known manner as by welding, brazing, rivets or threaded fasteners, for example. The action of these diagonal braces in concert with spacer rods 142 substantially increases the strength of the mooring assembly and enhances resistance to lateral distortion of the assembly relative to the wall of the waterfront structure 50, so as to assure that the boat 10 is maintained in proper mooring relationship to the waterfront in accordance with the intent and objectives of this invention.

Figure 9:
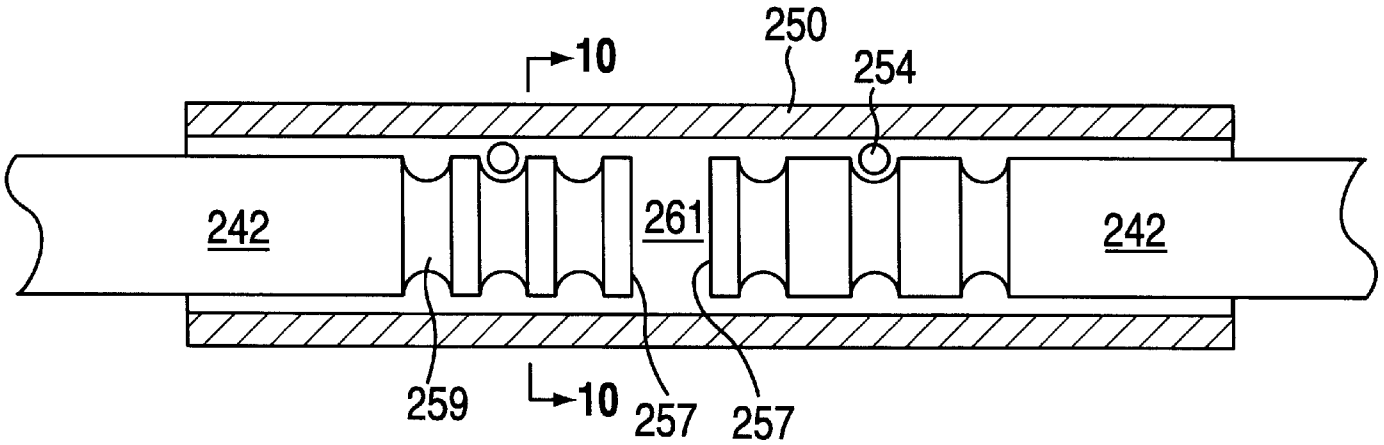
FIG. 9 is an illustration of another embodiment of the spacer rods and spacer sleeve of FIG. 7.
Figure 10:
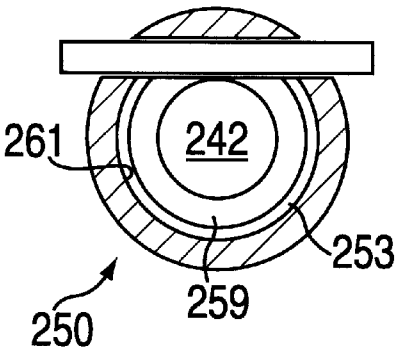
FIG. 10 is a cross sectional view of the embodiment of FIG. 9 taken along line 10—10 of that Figure.

Another embodiment of the invention is illustrated in FIGS. 9 and 10, in which the spacing sleeve 150 is identified by reference numeral 250 and spacer rods 142 are identified by numeral 242. Sleeve 250 is formed with a pair of axially spaced-apart sets of through-holes 254 extending through the wall of the sleeve. The axis of each set of holes corresponds to the line of a chord drawn across the circular cross-section of the central opening 251 in the sleeve. The chord line is preferably located dose to the inner surface 261 of the sleeve wall so that when a spacing pin 255 is inserted through the axially aligned holes of one of the sets, the outer surface of the pin is substantially adjacent to the inner surface of the sleeve. In this embodiment, each spacer rod 242 includes a plurality of longitudinally spaced apart annular grooves 259, formed near the free end 257 of each rod, so that the axial position of the rods within the sleeve can be fixed by aligning one of the grooves with one of the sets of holes and then inserting a spacer pin 255 through the set of holes so that it extends substantially tangentially across the selected groove, as shone most dearly in FIG. 10. In this position rod telescopic axial displacement of rod 242 within sleeve 250 is prevented by the interaction of pin 255 within groove 259 and against through-holes 254. The axial distance between adjacent grooves 259 can be selected to provide a desired range of adjustment that will allow sleeve 250 to be maintained as closely as possible in a substantially centered position between the opposed free ends 257 of the two rods 242. Maintaining sleeve 250 in position to overlap the free ends 257 substantially equally helps to enhance the ability of rods 242 and the associated mooring arms to resist the distorting and deflecting forces generated in use.

Figure 5:
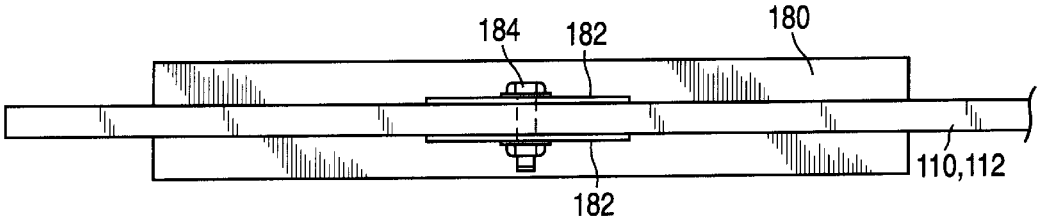
FIG. 5 is reverse plan view taken in the direction 5—5 of FIG. 1, showing a stepmounting detail of a mooring arm that forms part of the mooring assembly of FIG. 1.
Figure 6:
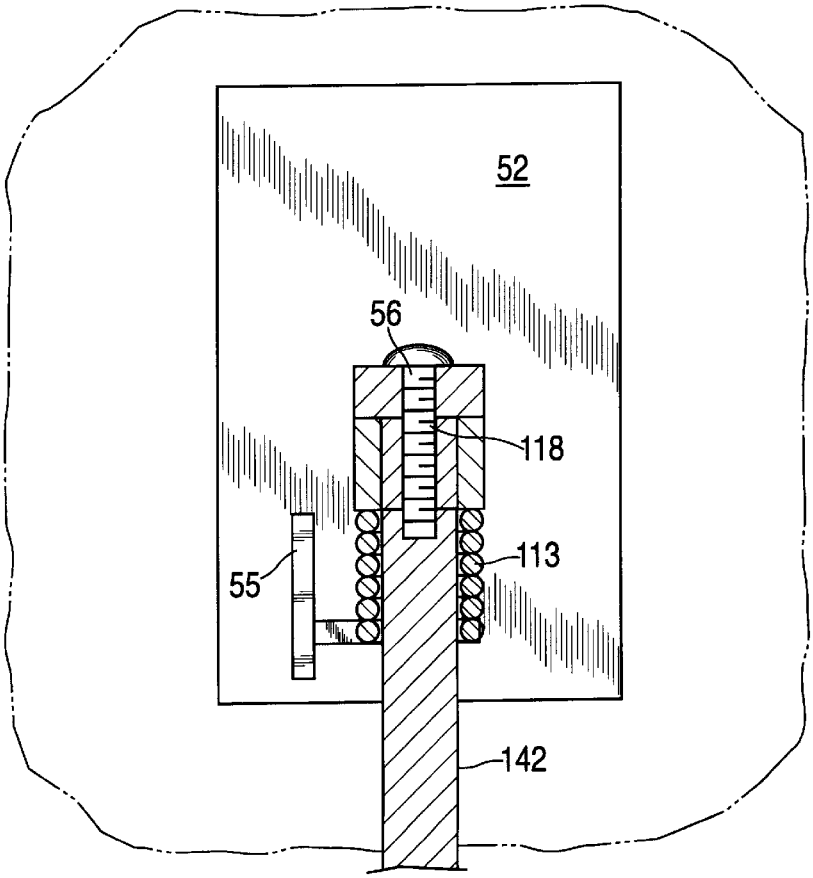
FIG. 6 is a section view taken along line 6—6 of FIG. 3.
Figure 7:
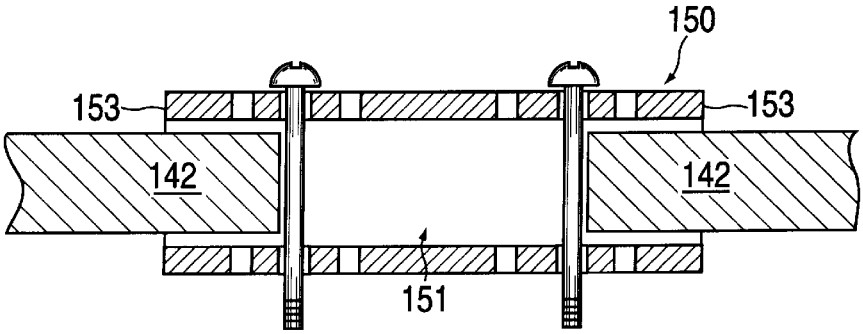
FIG. 7 is a section view of a spacer sleeve in accordance with this invention, taken along line 7—7 of FIG. 4.

The use and function of the mooring assembly of this invention is still further enhanced by the provision of mounting steps 180 on the upper surface of one or both of mooring arms 110, 112. The steps allow a user to achieve a firm foothold while stepping from the surface of the waterfront structure 50 onto a boat 10 while the boat is moored to the structure in accordance with this invention. The step 180 may be mounted conveniently to the arm 110,112 by means of a pair of projecting plates 182 that are securely attached to the underside of the step as shown in FIG. 5. The plates may be secured to the arm 110,112 in any convenient manner, as by a threaded bolt 184 extending through the plates 182 and through an aligned opening in the mooring arm, as shown.

Figure 8:
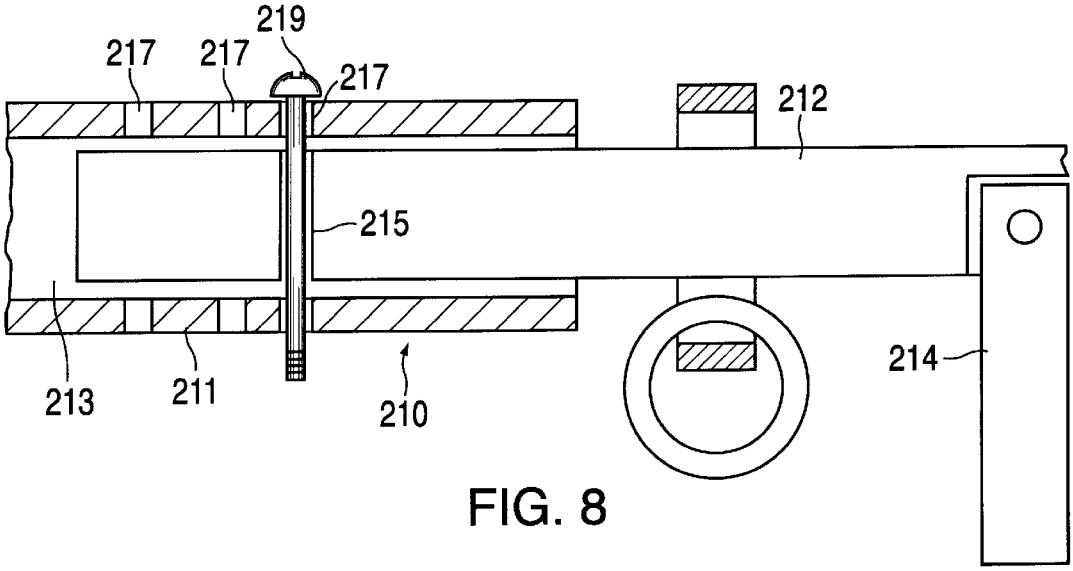
FIG. 8 is a partial sectional view of another embodiment of a mooring arm in accordance with this invention.

Up to this point, mooring arms 110,112 have been shown to be fixed in length. However, in another embodiment of this invention, one or both of the mooring arms may have a telescoping nature. Making either or both arms capable of telescopic expansion and contraction allows for adjustment in length to accommodate variations in the shape and/or positioning of either the boat or the waterfront structure, or both. FIG. 8 illustrates an adjustable length arm 210 having a first elongate portion 211 and a second elongate portion 212. The first elongate portion has an axially extending interior central space 213 that telescopically receives the second elongate portion therein to allow for relative motion to adjust the overall length of the arm. The desired relative position of the two elongate portions may be fixed by providing a transverse through hole 215 in one that can be aligned with one of a plurality of spaced apart holes 217 in the other, to receive a threaded bolt 219 or other suitable form of locking fastener.

Although preferred embodiments of the invention has been illustrated and described, it will be obvious to those having skill in this art that various other embodiments of the invention may be created without departing substantially from the spirit and scope of the invention set forth in the accompanying claims.

What is claimed is:

1. A mooring assembly for securing a boat to a waterfront structure, said assembly comprising:

a pair of pivot brackets mountable on a waterfront structure in spaced-apart relationship, each bracket having a pivot aperture formed therein, said apertures being positionable in substantially co-axial, spaced-apart relationship with the axis thereof being substantially parallel to the surface of the water when said brackets are mounted on said waterfront structure;

a pair of mooring brackets mountable on a surface of a boat in spaced-apart relationship, each mooring bracket having a mooring aperture formed therein, said apertures being positionable in substantially parallel, spaced-apart relationship with the respective axes thereof substantially perpendicular to the surface of the water when said brackets are mounted on said surface of said boat;

first and second elongate mooring arms each having a pivot end and a mooring end, each of said mooring arms having a pivot pin extending at a substantially right angle to the elongate axis of said mooring arm proximate said pivot end thereof, said pivot pins being engageable in respective ones of said pivot apertures to provide for pivotal movement of said pivot arms in planes substantially perpendicular to the surface of said water;

each of said first and second mooring arms further having an elongate spacer rod, extending from said mooring arm in substantially coaxial relationship with said pivot pin and terminating in a free end remote from said mooring arm and from said pivot pin associated therewith;

a substantially tubular spacing sleeve having a cylindrical central space open to the opposite ends of said sleeve and dimensioned to telescopically receive the said free ends of said spacer rods in co-axial alignment with each other, through the respective opposite ends of said sleeve;

each of said first and second mooring arms still further having a mooring pin extending at a substantially right angle to the elongate axis of said mooring arm proximate said mooring end thereof, said mooring pins being insertable into said mooring aperture of a respective one of said mooring brackets from the side of said bracket remote from the surface of the water, such that as each mooring arm pivots about the axis of the associated pivot pin, said mooring pin moves as a tangent to a circle having the said pivot pin as its center, and the weight of said mooring arm at said mooring end thereof is supported on said mooring bracket to urge said mooring pin into said mooring aperture.

2. A mooring assembly in accordance with claim 1 wherein:

each of said mooring pins includes a locking hole extending substantially diametrically therethrough at a given axial distance from said mooring arm, said given distance being not less than the thickness of said mooring bracket, and said mooring assembly further comprises a pair of locking pins dimensioned to extend through said locking holes and to project beyond the outer diameter of said locking pins so as to retain said mooring pins within said mooring apertures by capturing said mooring bracket between said mooring end of said mooring arm and said locking pin.

3. A mooring assembly in accordance with claim 1 wherein:

at least one of said first and second mooring arms further includes a step plate securely coupled thereto intermediate said pivot end and said mooring end thereof to serve as a stepping surface for a person stepping from said waterfront structure to a boat having a mooring bracket coupled to said mooring arm.

4. A mooring assembly in accordance with claim 1 wherein:

said mooring assembly further comprises a pair of biasing springs, each spring being interposed between a respective one of said mooring arms and the associated one of said mooring brackets for applying a predetermined spring force to bias said mooring arm against the force of gravity so as to maintain said mooring arm in substantially level position parallel to the surface of the water when said mooring bracket is mounted on a waterfront structure.

5. A mooring assembly in accordance with claim 4 wherein:

each of said biasing springs is a coil spring having the coil thereof encircling the common axis of said pivot pin and said spacer rod.

6. A mooring assembly in accordance with claim 1 wherein:

each of said mooring arms further includes a bracing member extending diagonally from a point on said mooring arm intermediate the ends thereof to a point on the associated one of said spacer rods intermediate the opposite ends of said spacer rod, for restricting displacement of said mooring arm out of perpendicular relationship with said associated spacer rod.

7. A mooring assembly in accordance with claim 1 wherein:

said spacing sleeve includes a plurality of axially spaced apart, substantially diametrical through-holes extending through opposed wall sections of said sleeve for receiving spacing pins to restrict the extent of telescopic insertion of said spacer rods into the said cylindrical central space of said sleeve.

8. A mooring assembly in accordance with claim 1 wherein:

said spacing sleeve further comprises a first and a second set of through holes extending through the wall of said sleeve such that the respective axes of said sets of through holes are substantially normal to the axis of said sleeve in axially spaced-apart relation therealong, and said assembly further includes a first and a second spacing pin disposable in said respective sets of through-holes and said pins lie adjacent the inner surface of said sleeve when disposed in said holes; and said spacer rods each further include a plurality of axially spaced apart, annular grooves formed thereon proximate the free end thereof, for engagement by portions of said spacer pins within said sleeve, to thereby restrict the extent of telescopic movement of said spacer rods within the said cylindrical central space of said sleeve.

9. A mooring assembly in accordance with claim 1 wherein:

each of said mooring arms comprises a first and a second elongate portion intermediate said mooring end and said pivot end of said mooring arm, said first elongate portion having an axially extending interior central space open to one end thereof for telescopically receiving said second elongate portion in sliding relationship therewith to permit axial extension and contraction of the length of said mooring arm between said mooring end and said pivot end.

* * * * *